United States Patent [19]

Fehr

[11] 4,383,710

[45] May 17, 1983

[54] PET LITTER RETRIEVER

[76] Inventor: Robert W. Fehr, 6621 Avenida Mirola, San Diego, Calif. 92123

[21] Appl. No.: 271,442

[22] Filed: Jun. 8, 1981

[51] Int. Cl.[3] ..... A01K 29/00

[52] U.S. Cl. ..... 294/1 BA

[58] Field of Search ..... 294/1 BA, 1 BB, 19 R, 294/22, 23, 50.8, 100; 15/104.8, 105, 257.1; 135/65, 66; 222/174, 323; 239/154, 287, 289, 526, 532; 401/137-140

[56] References Cited

U.S. PATENT DOCUMENTS

| | | | |
|---|---|---|---|
| 1,180,764 | 4/1916 | Derdits | 294/22 |
| 1,337,398 | 4/1920 | Fleckner | 294/19 R |
| 2,438,014 | 3/1948 | Lukowitz | 135/66 |
| 2,508,104 | 5/1950 | Dickensheets | 239/289 X |
| 2,609,557 | 9/1952 | Reed | 401/137 X |
| 3,139,299 | 6/1964 | Bowen | 294/1 BA |
| 3,328,066 | 6/1967 | Johnston | 294/19 R |
| 4,097,082 | 6/1978 | Orofino | 294/1 BA |
| 4,119,337 | 10/1978 | Sherhandt | 294/1 BA |

*Primary Examiner*—Johnny D. Cherry
*Attorney, Agent, or Firm*—Ralph S. Branscomb

[57] ABSTRACT

A pet litter retriever is provided which is characterized by a simple, unique mechanical actuation system which effects the closing and opening of a pair of blades which a plastic bag envelopes and is held in place by a clip such that dog droppings and the like may be enveloped in the bag and retained in place over the blades while the bag is inverted around the droppings to completely enclose same without soiling the retriever. An additional novel feature lies in the incorporation, in a selected one of two alternative embodiments, of a spray device used to spray the sidewalk or the like after the droppings have been removed, or if the droppings do not lend themselves to being bagged.

2 Claims, 6 Drawing Figures

20
14
12
10
48
50
10
40
38
34
10
36
32
44
30
26
42
28
24
22

14
16
12
18
10

48
52
54
56
50

34
36
32
30
44
28
26
46
22
24

10
30
28
22

10
32
30
42
30
22
28
26
24

PET LITTER RETRIEVER

BACKGROUND OF THE INVENTION

In New York City and other places of high population density ecological consciousness has prompted the enactment of animal litter laws, in some instances invoking a stiff fine for pet owners who let their animals, generally dogs, litter the sidewalks or public places.

In response to this change in consciousness of those who are affected by the animal owning public, a number of litter scoopers have been developed, or at least designed and patented. Although presently on the market there appears to be a simple pan and boom device, issued patents cover a much wider variety of "pooper scoopers."

Some of these devices use a dustpan-type enclosure with some means of sweeping the droppings inside. At least one of these, shown in U.S. Pat. No. 3,868,135 utilizes a bag liner to prevent the pan from getting dirty in use.

Others, which pertain more closely to the instant device, are illustrated in U.S. Pat. Nos. 3,606,436 and 3,446,525. Both of these devices utilize bars that swing together at the bottom of a long shaft from a spaced apart position to a side-byside parallel position to scoop under droppings, there being a bag which is enveloped over the prongs or blades before the blades are used, so that the droppings end up inside the bag.

This type of pooper scooper naturally has a significant advantage over pooper scooper which become soiled with use, although some of the latter type of pooper scooper are easy to rinse in toilet bowls or the like. However, the type which utilizes a liner or bag, at least the art illustrated in the Patent Office, does not always represent the most physically convenient implementation of the general concept. In the instance of U.S. Pat. No. 3,606,436 a pair of bars must be manually swung together while maintaining the proper position and angle of the bottom blades, which would be awkward. In U.S. Pat. No. 3,446,525, a convenient one-handed trigger action is used, but the device remains closed in its biased position, and must be maintained open against the spring bias, requiring some effort on the part of the user during alignment and collection of droppings.

Additionally, although the prior art may suffice to clean large, solid dry droppings, they are completely inadequate for taking care of watery leavings, or the part of other droppings remaining embedded in the sidewalk.

SUMMARY OF THE INVENTION

The present invention fulfills the above stated gaps in the art by providing a pooper scooper, or pet litter retriever, which utilizes a pair of blades which swing together beneath the droppings to wrap a bag around them, but does so by a double over-the-center action made possible by a unique linkage mechanism so that the scissor bars remain stable in either the open or the closed position, but once moved from the completely open position will spring shut into the closed position, from whence the secondary over-the-center action can be effectuated by the actuator handle to positively lock the blades shut.

This rather complicated result is achieved in such an elegant and simple way by the use of an over-the-center lever connected to an actuator rod with a wishbone spring at the end, that a rare combination of perfection of motion and economy of construction is achieved.

In addition to this unique operation which would itself be sufficiently novel to warrant a patent and pursuit of a market for the invention, a sprayer system is incorporated which takes advantage of the existing cylindrical shaft as a fluid reservoir, so that the remaining leavings after the scissors and bag have been operated can be sprayed clear of the sidewalk or other pavement surface which they previously marred.

The sprayer assembly is disclosed in two basic embodiments one utilizing a removeable hand sprayer which has a long tube drawing on the fluid in the reservoir, and the other utilizing a fixed spray head mounted to the bottom of the main support shaft which is actuated by a trigger or the like at the top of the shaft.

DETAILED DESCRIPTION OF THE PREFERRED EMBODIMENT

Figures 1, 2, 3, 4, 5, 6:
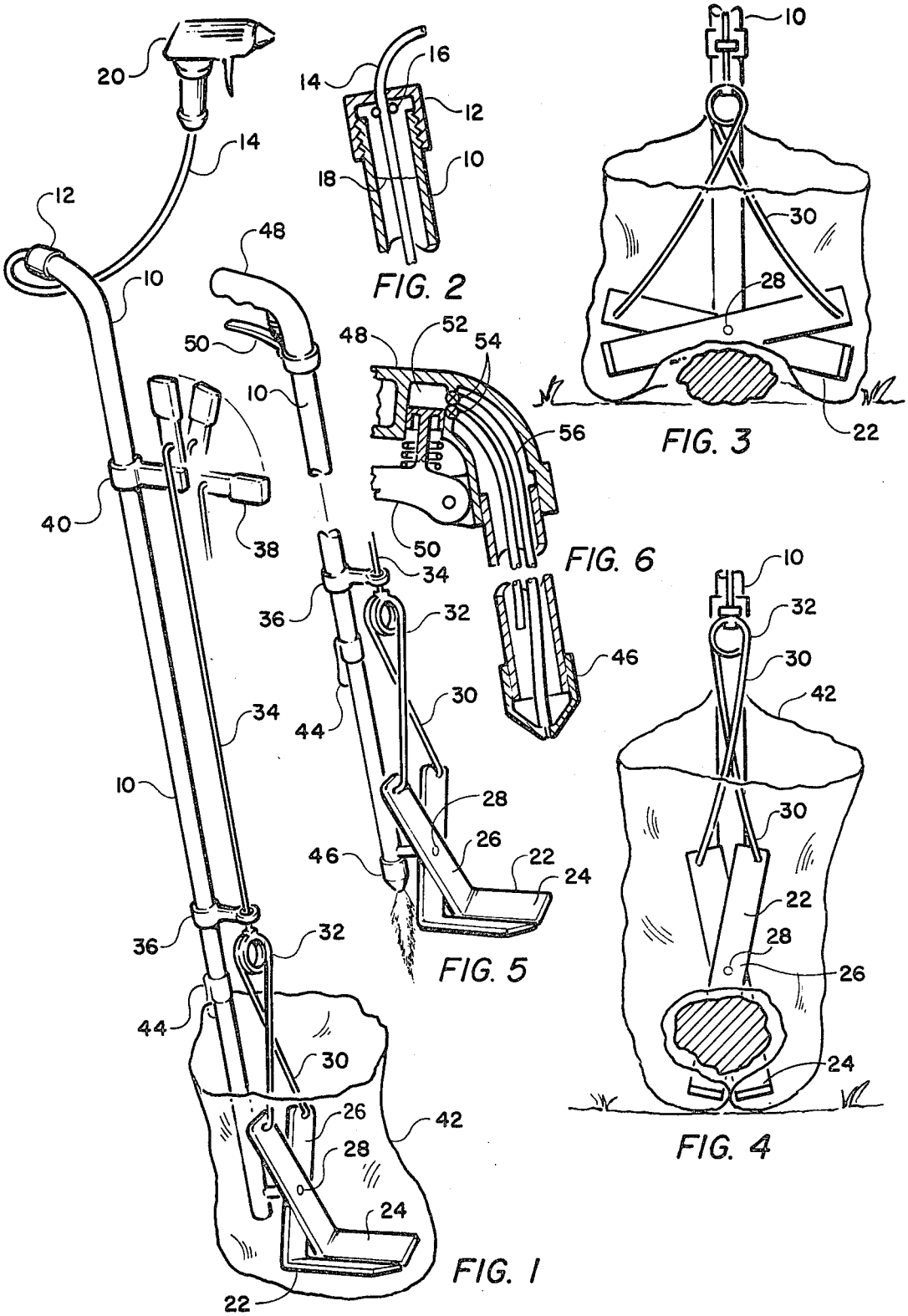
FIG. 1 is a perspective view of the unit with a bag in place.
FIG. 2 is a detail of the top end of the retriever.
FIG. 3 illustrates the collector blades in expanded position over a dropping.
FIG. 4 illustrates the collector blades closed with the bag around a dropping.
FIG. 5 illustrates a modification of a sprayer mechanism.
FIG. 6 is a section through a portion of the handle and nozzle of the device illustrating the modification of FIG. 5.

The principal embodiment of the invention is shown in FIG. 1 where a main shaft 10 has a plugged bottom, not shown, and a cap 12 with a hole through the center which passes therethrough a tube 14 into the interior of the shaft. The shaft acts as a cylindrical reservoir for fluid and a rubber band or other enlargement 16 shown in the detail in FIG. 2 prevents the tube from drawing too far out of the shaft so that fluid within the shaft, indicated at 18 in FIG. 2, will be available through the tube for action of the sprayer 20. The spray head 20 thus has complete freedom of motion, and can be used with one hand while the other hand holds the remainder of the retriever.

At the bottom of the shaft are a pair of L-shaped members 22 having horizontal blades 24 and upright shanks 26, the latter being pivoted at 28 to the bottom of the shaft. Upper holes in the shanks 26 permit engagement of a wishbone spring rod 30 having a coiled top 32 which is gripped by the bottom of actuator rod 34. The actuator rod slides at its lower extremity in guide 36, and connects at the top to actuator lever 38, with a mount 40 permitting an over-the-center action shown in FIG. 1.

The wishbone spring actually biases the upper ends of the shank, and therefore the blades, together into the position indicated in FIG. 1. Thus, the over-the-center action of the actuator 38 is not needed to close the blades, but merely to lock them into place.

At the other extreme, when the lever 38 is pushed all the way down, the blades spread as shown in FIG. 3, and another, different over-the-center action is achieved by the critical position of the points of attachment of the ends of the wishbone vis-a-vis the pivot point 28. This can occur even when the wishbone tips are slightly above the pivot point, probably because the forced vectors at the tips of the wishbone do not point toward one another, but rather somewhat perpendicular to the ends of the wishbone at that point, which would cross them beneath the pivot point. In any event, however, it works, and has the significantly beneficial effect of maintaining the blades open automatically, so that careful positioning of the unit can be effected without simultaneously maintaining this spread of the blades.

Once the device has been properly positioned, preferably with a bag 42 which is engaged by the clip 44 spread over the blades, a slight upward movement of the lever 38 to bring the wishbone back from its lowermost position will cause a snapping, self-powered closing of the lower blades, into the position shown in FIG. 4. As indicated above, positive locking is then effected by drawing the lever all the way back.

Thus, it can be seen that mechanically the mechanism is so simple, and yet so effective, that it is hard to imagine any lacking in the physical motion of the device. The blades even execute a swinging arc motion when closed, which works better to accumulate debris than a straight horizontal motion. This is especially true in grass and other obstructed areas.

Turning again to the sprayer side of the invention, an alternative embodiment is shown in FIGS. 5 and 6. This embodiment is not binding, but is intended to be exemplary of an implementation of the general idea wherein the nozzle is directly connected to the bottom or lower portion of the shaft as at 46, and the actuation is accomplished near the handle 48, such as by action of trigger 50 which operated pump 52 through checkvalves 54, pumping fluid from the reservoir and down to the nozzle by means of interior tubes 56. Equally feasible would be a small pump down at the nozzle position, mechanically driven by a trigger or the like adjacent the handle. In any of its implementations, the instant invention represents the latest in pooper scoopers, combining features from the past together with novel mechanical operative characteristics, and the feature of incorporating liquid spray cleaning with the mechanical act of collecting droppings.

While I have described the preferred embodiment of the invention, other embodiments may be devised and different uses may be achieved without departing from the spirit and scope of the appended claims.

What is claimed is:

1. A pet litter retriever comprising:

(a) an elongated main shaft;

(b) a dropping collector structure mounted on the bottom of said shaft;

(c) an actuator mounted on said shaft and being operative from the upper portion of said shaft to control said collector;

(d) a spray means mounted on the top of said shaft and being usable to spray fluid on a sidewalk or other surface to rinse same;

(e) said main shaft defining a hollow cylinder plugged at the bottom to serve as a fluid reservoir for said spray means so that said spray means can be used independently of any hose water source; and (f) said spray means including a spray head having a tube extending down to the bottom of said reservoir communicating with said reservoir.

2. A pet litter retriever comprising:

(a) an elongated main shaft;

(b) a pair of L-shaped collector elements each comprising a shank with an orthogonally extended blade, and said elements being pivoted together and to said shaft generally centrally of their shanks with the blades extending horizontally therefrom;

(c) an actuator rod longitudinally slideably mounted to said shaft;

(d) an actuator lever pivotally mounted to an upper portion of said shank with the upper end of said actuator rod being pivotally mounted to said lever;

(e) a wishbone spring centrally gripped by the lower end of said actuator rod and having depending inwardly biased spring arms pivotally connected to the tops of said shanks so that said blades are normally biased closed;

(f) said spring being sized and mounted relative to the point of pivotal connection of said shanks to said shaft such that when said spring is forced downwardly, said blades open, and when said blades are open a certain distance, said spring arms have inwardly directed bias vectors which cross below the point of pivotal connection of said shanks to said shaft, and said blades thus remain in the open position until said actuating lever is operated to raise said spring to bring the crossing points of the bias vectors thereof above the point of pivotal connection of said shanks to said shaft.

* * * * *